United States Patent [19]

Woodhouse et al.

[11] 4,194,893

[45] Mar. 25, 1980

[54] PUMPING APPARATUS

[76] Inventors: Ronald Woodhouse; Walter W. Russell, both of 403/433, Woolwich Rd., Charlton, London, SE7 7AP, England

[21] Appl. No.: 826,116

[22] Filed: Aug. 19, 1977

Related U.S. Application Data

[62] Division of Ser. No. 614,085, Sep. 17, 1975, abandoned.

[30] Foreign Application Priority Data

Sep. 17, 1974 [GB] United Kingdom ..... 40565/74

[51] Int. Cl.[2] ..... B01D 19/00

[52] U.S. Cl. ..... 55/168; 137/202; 55/473

[58] Field of Search ..... 55/167, 168, 216, 417, 55/473; 137/202, 205

[56] References Cited

U.S. PATENT DOCUMENTS

| | | | |
|---|---|---|---|
| 2,322,910 | 6/1943 | Adney | 137/202 |
| 2,927,597 | 3/1960 | Brentley | 137/205 |
| 3,726,303 | 4/1973 | Allen et al. | 137/202 |

FOREIGN PATENT DOCUMENTS

| | | | |
|---|---|---|---|
| 755249 | 8/1956 | United Kingdom | 137/202 |

*Primary Examiner*—Bernard Nozick
*Attorney, Agent, or Firm*—Jacobi, Lilling & Siegel

[57] ABSTRACT

A pumping apparatus, more especially for fluid materials containing entrained gas pockets, comprises a single entry centrifugal impeller pump and means for maintaining a reduced pressure on the side of the impeller opposite said single entry to the pump. The pump impeller may have gas evacuation passages extending through the impeller disc from orifices located on the low pressure side of the impeller blades. The pumping apparatus preferably includes a liquid chamber communicating with the pump casing on said opposite side of the impeller, means controlled by the liquid level in said chamber for connecting the latter either with a vacuum source or with atmosphere, and means responsive to atmospheric pressure within said chamber for discharging liquid therefrom to the inlet side of the centrifugal pump.

3 Claims, 4 Drawing Figures

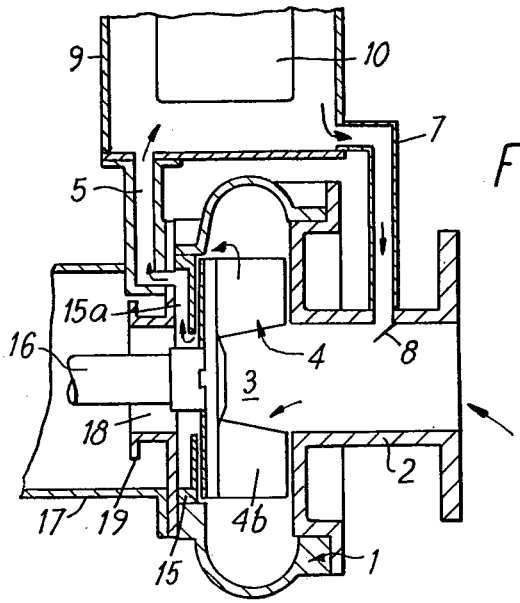
FIG. 1
FIG. 2
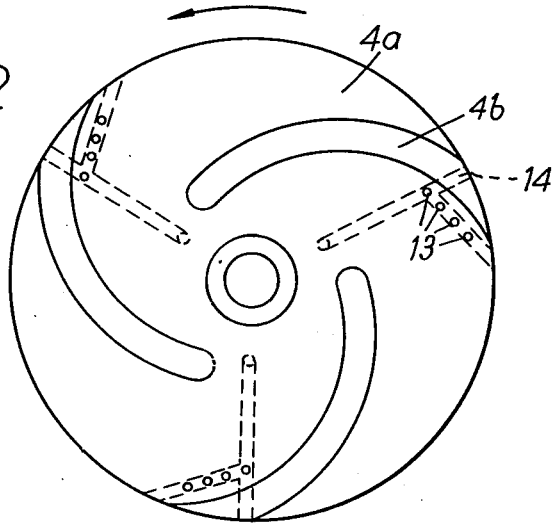
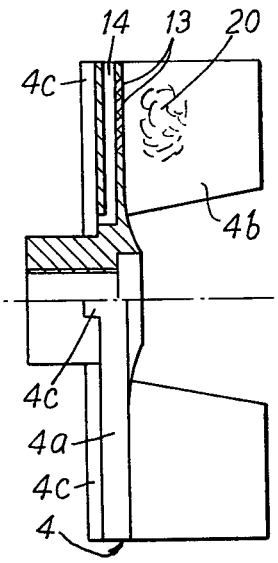
FIG. 3

PUMPING APPARATUS

This is a Division of application Ser. No. 614,085, filed Sept. 17, 1975 now abandoned.

BACKGROUND OF THE INVENTION

This invention concerns improvements in pumping apparatus, and more especially, but not exclusively, to apparatus for use in the pumping of fluid materials containing entrained gas pockets. Such materials may include, for example, gaseous sludges and/or like materials which give off gases when circulated in a centrifugal pump, and also liquids which contain entrained air owing, for example, to admission of air into an intake pipe of a centrifugal pump owing to exposure of the inlet to the pipe.

It is known that a centrifugal impeller pump may become gas-locked owing to an accumulation of gas pockets around blades of the pump impeller, due either to inherent gas within the material being pumped being given up as a result of agitation of the material within the pump, or, owing to inadvertent leakage of air into the intake of the pump.

SUMMARY OF THE INVENTION

It is an object of the present invention to provide an improved pumping apparatus incorporating a centrifugal impeller pump, in which the tendency for the impeller of the pump to become gas-locked by gas pockets formed within the pump, is reduced.

The present invention accordingly provides a pumping apparatus comprising a single-entry centrifugal impeller pump, and means for maintaining a reduced pressure at the volute of the pump on the rear side of the impeller opposite the single entry to the eye of the impeller, during operation of the pump.

In an apparatus according to the present invention, any gas pockets formed within the volute of the pump around the impeller blades, on the entry side of the impeller, tend to be drawn off around the periphery of the impeller to the reduced pressure zone at the rear side of the impeller, and thus the tendency for gas-locking of the impeller to occur is reduced. An apparatus according to the invention therefore provides a more efficient means of pumping materials such as gaseous sludges, and is also able to cope with so-called "snore" conditions occuring when the level of a liquid being pumped by a centrifugal pump temporarily falls below the end of a suction pipe of the pump, causing a mixture of liquid and air to be admitted to the pump. Such conditions commonly occur, for example, during dewatering of ground.

Preferably, the reduced pressure maintained at the rear side of the impeller of the centrifugal pump is derived from a continuously running vacuum pump, and in this case it is necessary that any liquid material drawn from the rear side of the impeller as a result of such reduced pressure is prevented from reaching the vacuum pump. Also, it is desirable that any liquid accumulating at the rear of the impeller is regularly discharged from the pump, in order to prevent the occurrence of a liquid seal at the rear side of the impeller. Such a liquid seal would obstruct the passage of gas from the zone around the periphery of the impeller blades to the reduced pressure zone at the rear of the impeller.

According to a preferred feature of the invention, therefore, the said means for maintaining said reduced pressure includes a liquid chamber arranged, when in use, to be above the level of the volute of the centrifugal pump, said liquid chamber communicating with said volute on the side of the impeller opposite to the single entry to the eye of said impeller, a valve means controlled in accordance with the liquid level within said liquid chamber and arranged initially to connect the interior of said chamber to a source of vacuum and then, upon raising of the liquid level within said chamber, to atmosphere, and means arranged, when said liquid chamber is connected to atmosphere, to cause liquid within said liquid chamber to be discharged therefrom through said centrifugal pump.

In order to permit the more effective evacuation of gas from areas within the periphery of the impeller, the said impeller preferably has gas evacuation passages extending through the impeller disc. The said gas passages preferably extend from orifices arranged on the low pressure side of the impeller blades, with reference to the direction of rotation of the impeller. Advantageously, a plurality of said orifices are arranged adjacent each impeller blade, as a radially extending series.

At least that portion of each gas evacuation passage adjacent to the face of the impeller may extend radially outwards towards said face, to promote removal of any solid matter tending to block said passages, by centrifugal force.

According to one embodiment of the invention, the said means to cause liquid within said liquid chamber to be discharged through said centrifugal pump comprises a return pipe extending from said liquid chamber to the said volute on the single entry side of the impeller, said return pipe being provided with a one-way valve arranged to be opened when the pressure within said liquid chamber exceeds that on the entry side of the pump.

Alternatively, the said means may comprise a plurality of secondary impeller blades provided at the said rear side of said impeller, the arrangement being such that when said liquid chamber is connected to atmosphere the said secondary impeller blades are effective to pump liquid from the liquid chamber to the inlet side of said impeller.

BRIEF DESCRIPTION OF THE DRAWINGS

FIG. 1 is a diagrammatic sectional elevation of a pumping apparatus in accordance with the invention, FIG. 2 is a front elevational of the impeller of the centrifugal pump shown in FIG. 1, FIG. 3 is a side elevation, partly in section, of the impeller shown in FIG. 2.

DESCRIPTION OF PREFERRED EMBODIMENTS OF THE INVENTION

Figure 4:
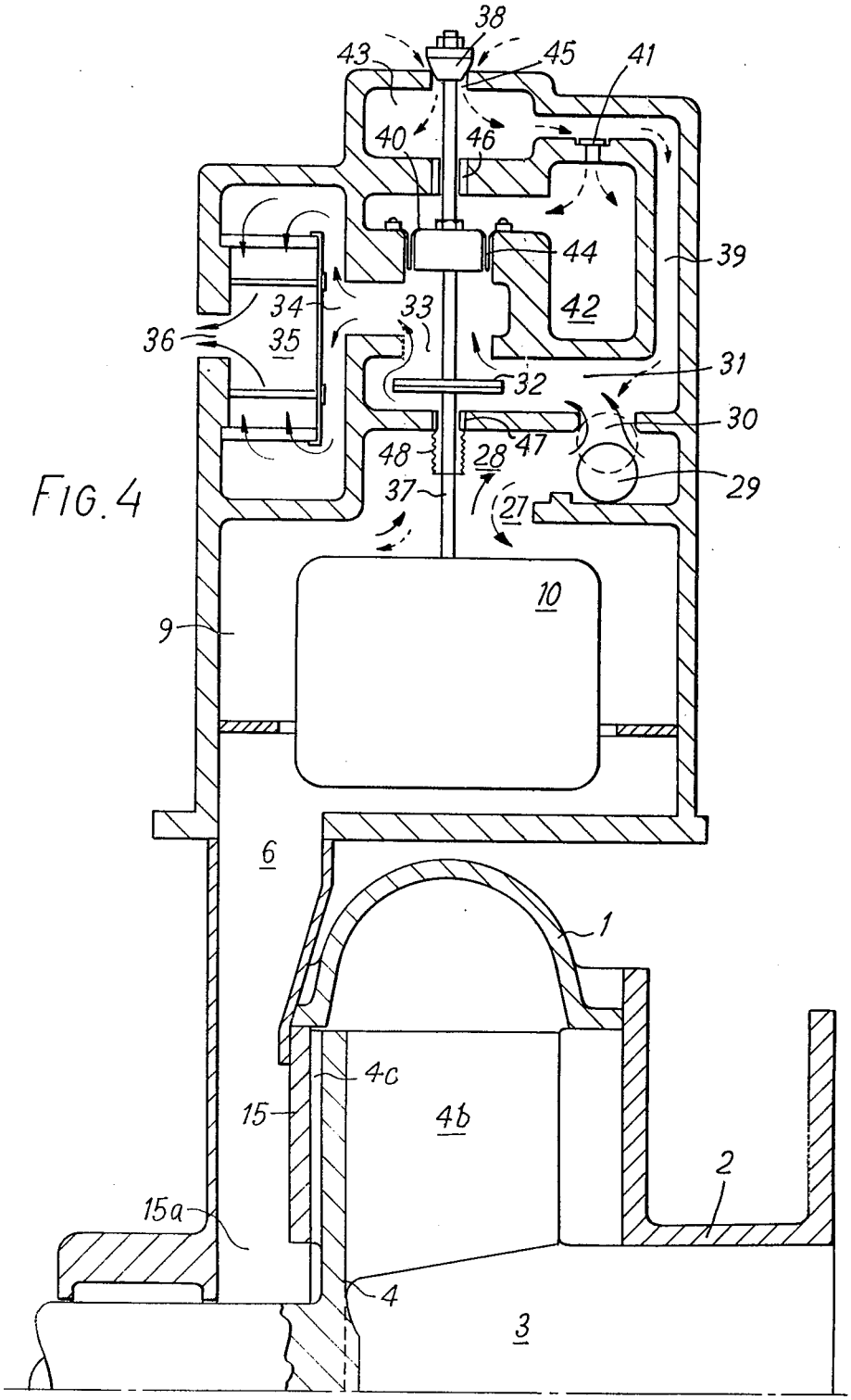
FIG. 4 is a diagrammatic sectional elevation of a further embodiment of apparatus according to the invention.

Referring to the drawings, an apparatus in accordance with the invention comprises a centrifugal pump which is of a conventional single entry type, wherein the fluid material to be pumped passes via a suction pipe 2 to an eye 3 of the impeller 4 of the pump and is discharged at a peripheral delivery outlet, not shown. The casing 1 of the pump incorporates an outlet duct 5 communicating with the volute of the pump at the back of the impeller, as shown. The pump also has a return pipe 7 communicating with the inlet side of the pump, and controlled by a non-return valve 8. The pipes 5 and 7 are connected with a liquid chamber 9 containing a float valve 10 for controlling the connection of the chamber 9 either to a vacuum pump, or to atmosphere. The vacuum pump, together with the chamber 9 and the associated float valve 10 may be of conventional type as used for the priming of centrifugal liquid pumps, see for example British Patent Specification Nos. 755,249 and 1,342,086.

The impeller 4 of the centrifugal pump is of conventional type comprising an impeller disc 4a and impeller blades 4b extending axially therefrom, but is modified by the provision of gas passages 13 extending through the impeller disc and small radial blades 4c at the rear of the impeller (FIG. 3). The gas passages 13 may either extend fully through the impeller disc to a low pressure area therebehind, or, as illustrated in more detail in FIG. 3, may communicate with a radial passage 14 extending from the region of the hub of the disc to the periphery thereof. The impeller disc 4a is blocked by means of a rubbing plate 15 defining a gas passage 15a communicating between the pipe 6 and the passage 14 within the impeller. The impeller 4 is driven via a shaft 16 of a motor (not shown) to which the pump is connected by a matching piece 17. The shaft 16 is sealed within the pump casing 1 by means of a greasy packing material 18 held within a carrier 19.

The operation of the arrangement described above is as follow. The pump 1 and the vacuum pump, not shown, are both arranged to run continuously, and during starting up of the pump 1 the liquid chamber 9 will be empty, so that it is subjected to a vacuum from the vacuum pump, the pump 1 also being subjected to a vacuum by way of the pipe 6. At this time the non-return valve 8 will be closed by the reduced pressure within the pipe 7. The vacuum within the pump 1 will assist priming of the latter until material to be pumped reaches the eye 3 of the impeller 4. The pump 1 will now commence to pump fluid material from the suction pipe 2 to the delivery outlet, in the conventional manner, and in the event of liquid being drawn from the pump 1 to the liquid chamber 9 via the pipe 6, the float valve 10 will operate to subject the chamber 9 to atmospheric pressure. Atmospheric pressure will therefore obtain within the pipe 7 and the liquid will be drawn from the chamber 9 through the pipe 7 and the non-return valve 8 owing to the suction at the eye of the impeller 3. The liquid remaining at the rear of the impeller 4 and within the duct 6 will also be pumped back to the entry side of the pump by means of the rear impeller blades 4c.

When pumping sludges of a gaseous nature, the sludge will tend to give up the gas, which will accumulate in pockets 20 behind the blades of the impeller in low pressure areas (see FIG. 3). However, reduced pressure maintained at the back of the impeller by the vacuum pump will cause the gas to be evacuated from these gas pockets via the passages 13 and 14, so that gas-locking of the impeller is prevented. Any tendency for the passages 13 to become blocked by solid material will be ameliorated owing to the radially outward inclination of the passages which will cause material therein to be thrown outwards under centrifugal force. However, even in the event of blockage of the passages 13 some evacuation of the gas from the pockets 14 will take place around the whole length of the outer periphery of the impeller disc, so that the effectiveness of the pump in handling gaseous sludges is considerably improved.

The removal of entrained gas in the manner described above is also effective during pumping of liquids which may contain entrained gas, for example due to leakage of air into the suction pipe 2. Furthermore, the arrangement described enables the initial priming of the centrifugal pump to take place from the rear of the impeller, rather than from the front, as is conventional with horizontal centrifugal pumps, which is of considerable advantage in preventing large solids from passing to and accumulating in the chamber 9, as well as reducing the effect of any disadvantageous leakage of gas through the impeller shaft seal. It is also envisaged that such priming from the rear of the impeller may be applied to exposed vertical pumps, i.e. in which the impeller axis is vertical, and may render such pumps applicable to conditions hitherto requiring a submersible pump.

Referring now to FIG. 4 of the drawings, there is shown a further embodiment of the invention, in which the requirement for a return pipe 7 and one-way valve 8 is avoided. This arrangement is particularly advantageous in the case where it is desired to pump materials containing solids which may interfere with the operation of the valve 8. In FIG. 4, parts of the apparatus corresponding to those shown in FIG. 1 are referenced by like numerals, and will not be referred to in more detail. In this arrangement, the omission of the return pipe 7 is enabled by providing for the rear impeller blades 4c to effect the discharge of liquid both from the duct 6 and from the chamber 9 to the entry side of the pump, via the space between the blades 4c. However, in order to enable sufficient time for the complete pumping out of the chamber 9 by this means, the conventional float valve mechanism referred to in connection with FIG. 1 is replaced by a modified float valve mechanism constructed as follows.

Above the float 10 is a port 27 communicating with an upper part 28 of the float chamber which contains a ball valve 29 cooperating with a seated port 30. The port 30 communicates with a secondary chamber 31, which for practical purposes may be considered as a continuation of the float chamber 9. The chamber 31 communicates on the one hand via a further port 33, and an exhaust passage, including a filter chamber 34, a filter 35 and an evacuation port 36, with a vacuum source (not shown), and on the other hand via a passage 39, a chamber 43 and an orifice 45, with atmosphere. The pump further comprises an air reservoir 42 which communicates with the passage 39 via an air bleed orifice 41. The float 10 is connected to a spindle 37 to which are fixed respectively a first valve member 32 for closing the port 33, and a second valve member 38 for opening the orifice 45 to atmosphere. In addition, a balancing member 40, provided on the spindle 37 and sealed by means of a diaphragm 44, is located between the air reservoir 42 and the exhaust passage to the vacuum source. The spindle 37 is slidably mounted in bearings 46 and 47, and the bearing 47 is sealed against entry of air or liquid, by means of a diaphragm 48. The bearing 46 may likewise be sealed if necessary (see below).

The operation of the valve mechanism is as follows.

Upon starting the pump with the suction pipe covered, the evacuation system will remove the air in the following manner. The pressure will be reduced at the vacuum source causing a flow from the suction pipe to the pump casing 1. The air will continue to be drawn off around the back blades 4c of the impeller 4, these being dry at this stage, and through the duct 6 to the float chamber 9. On rising beyond the float 10 the air will pass through the open port 27 and into the upper part 28 of the chamber where any airborne liquid is trapped before the air passes beyond the ball valve 29 and through the seated port 30 into the chamber 31. The air then continues past the valve member 32 through the seated port 33 to the filter chamber 34. It then passes through the filter 35 and continues to the evacuation source via the port 36.

Due to the drop in internal pressure, the pumped media will follow the path of the air outlined above, and once beyond the eye 3 of the impeller 4, the pump will be primed. The liquid will continue to rise beyond and into the float chamber 9, however, and upon reaching the floatation point of the float 10 will cause this to rise. Upon raising of the float 10, the valve member 32 is closed against the seated port 33, effectively sealing the evacuation system, and the valve member 38 is caused to open, allowing air to be admitted at atmospheric pressure. Atmospheric air thus passes through the orifice 45 and passage 39 into the chamber 31 and thence via the seated port 30 into the upper part 28 of the float chamber and collects any residual wetness before discharging through the port into the main part of the float chamber 9, thus raising the pressure in this chamber. This rise in pressure will cause the liquid to fall below the flotation point of the float and, aided by the pumping action of the blades 4c on the impeller 4, the water will be pumped out of the float chamber.

When the float 10 raised and valve member 32 shut, the valve member 38 is open, and there is maximum developed vacuum in the exhaust passage. Atmospheric air is admitted via the orifice 45 and the orifice 41 into the reservoir 42 to a point above the member 40 and via the passage 39 and chamber 31 to a point below the valve member 32. There is therefore a pressure drop across the balancing member 40 and the outlet valve 32. By balancing the areas of the members 32 and 40, therefore, there are no extraneous forces acting either upwards or downwards causing movement of spindle 37, disregarding the weight of the spindle 37 and components carried by it. However, the presence of the orifice 41 and the reservoir 42 initially puts this balanced valve system out of balance for a short period of time following closure of the valve member 32 so that sufficient time elapses for all of the liquid to be pumped from the float chamber 9 before the float 10 and valves 32 and 38 fall. This is achieved in that the orifice 41 restricts the speed at which the air above the member 40 in chamber 42 acquires the pressure of that in chamber 31 below the outlet valve 32. Hence there is a resultant force due to the differential pressure on either side of chamber 34 holding the valve member 32 closed. Once all the liquid is pumped from the float chamber 9 the impeller back passages are free of liquid from this source and there is again a free passage for air to be drawn into the float chamber. As soon as the balance of the valve system is now restored, the float 10 is free to fall, and the vacuum source is reconnected to the float chamber 9 for re-priming thereof.

We claim:

1. A single entry centrifugal impeller pump comprising, a volute casing having axial end walls with an inlet orifice in one axial end wall, a peripheral outlet, and a gas exhaust passage in the other end wall; an impeller having an impeller disc mounted for rotation with its rear face adjacent said other axial end wall of the volute casing, and a plurality of impeller blades extending from the front face of the impeller to define an eye of the impeller in communication with said inlet orifice of the volute casing; a liquid reservoir chamber located above and in communication with said gas exhaust passage of the volute casing, said chamber having a first outlet for connection to a gas exhaust means and a second outlet communicating with atmosphere; a float valve mechanism located in said reservoir chamber and having first and second valve members arranged, upon raising of the float within said chamber, respectively to close said first outlet and to open said second outlet; means for discharging liquid from said reservoir chamber to the front side of said impeller when said reservoir chamber is at atmospheric pressure; and means for delaying movement of said float valve mechanism to open said first outlet and close said second outlet in response to a fall of liquid level in said reservoir chamber; said means for delaying movement of said float valve mechanism comprising an air reservoir having an air bleed orifice communicating with said float chamber, and a balancing member coupled to said float valve mechanism and exposed on the one hand to the fluid pressure prevailing upstream of said first outlet and on the other hand to the fluid pressure prevailing in said air reservoir.

2. A pump as claimed in claim 1, wherein said first and second valve members and said balancing member are mounted upon a common valve spindle passing respectively through said first outlet, through an aperture in a partition between an exhaust gas passage upstream of said first outlet and said air reservoir, and through said second outlet, the said balancing member having an area substantially the same as said first outlet and being movably mounted within said aperture and sealing the latter against the passage of air.

3. A pump as claimed in claim 2, wherein said balancing member is connected to said partition by a flexible diaphragm closing said aperture.

* * * * *